US008258437B2

(12) United States Patent
Donarski et al.

(10) Patent No.: US 8,258,437 B2
(45) Date of Patent: Sep. 4, 2012

(54) NON-CONCENTRIC SURFACE HEATING ELEMENT SWITCH

(75) Inventors: Robert S. Donarski, Stevensville, MI (US); Stephen A. Pickard, Cleveland, TN (US); Steven M. Swayne, Chattanooga, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 548 days.

(21) Appl. No.: 12/548,547

(22) Filed: Aug. 27, 2009

(65) Prior Publication Data

US 2011/0049127 A1 Mar. 3, 2011

(51) Int. Cl.
*H05B 3/68* (2006.01)

(52) U.S. Cl. ..... 219/443.1; 219/462.1; 219/486; 219/448.17

(58) Field of Classification Search ..... 219/448.17, 219/457.1, 462.1, 486, 483, 484, 398, 452.12, 219/443.1
See application file for complete search history.

(56) References Cited

U.S. PATENT DOCUMENTS 4,973,933 A 11/1990 Kadlubowski
6,018,149 A * 1/2000 Higgins ..... 219/462.1
6,057,529 A 5/2000 Kirby
6,111,231 A 8/2000 Corson et al.
6,285,012 B1 9/2001 Connolly et al.
6,586,712 B1 7/2003 Mathews, Jr. et al.
6,693,262 B2 * 2/2004 Gerola et al. ..... 219/462.1
6,753,511 B2 6/2004 Mathews, Jr. et al.
6,995,344 B2 * 2/2006 McWilliams ..... 219/448.17
7,145,109 B2 12/2006 Wilde et al.
7,208,704 B1 4/2007 Couts
7,230,209 B2 6/2007 Sterling
7,307,246 B2 12/2007 Smolenski et al.
7,388,175 B2 6/2008 Lamb
8,193,473 B2 * 6/2012 Unno ..... 219/444.1
2004/0262289 A1 * 12/2004 Sauter et al. ..... 219/483
2009/0057292 A1 * 3/2009 Oyler et al. ..... 219/394
2010/0200565 A1 * 8/2010 Leung et al. ..... 219/443.1
2010/0206867 A1 * 8/2010 Acero Acero et al. ..... 219/468.1
2011/0147366 A1 * 6/2011 Franca et al. ..... 219/443.1
2011/0272393 A1 * 11/2011 Donarski et al. ..... 219/443.1
2011/0284518 A1 * 11/2011 Elston et al. ..... 219/391
2011/0290782 A1 * 12/2011 Donarski ..... 219/443.1

* cited by examiner

*Primary Examiner* — Savitr Mulpuri
(74) *Attorney, Agent, or Firm* — Jason S. Burnette; Barnes & Thornburg LLP

(57) ABSTRACT

A cooking appliance has a cooktop including a plurality of separately controlled cooking areas. A first heating element and a second heating element are positioned below one of the separately controlled cooking areas. A control switch is coupled to the first heating element and the second heating element and is operable to selectively energize the first heating element and the second heating element.

10 Claims, 3 Drawing Sheets

NON-CONCENTRIC SURFACE HEATING ELEMENT SWITCH

TECHNICAL FIELD

The present disclosure relates generally to cooking appliances. The present disclosure relates more particularly to control switches for operating the heating elements of cooking appliances.

BACKGROUND

A cooking appliance is used to cook meals and other foodstuffs on a cooktop or within an oven. The cooking appliance typically includes various control switches and electronics to control the heating elements of the cooking appliance.

SUMMARY

According to one aspect, a cooking appliance has a cooktop including a plurality of separately controlled cooking areas. The cooking appliance also has a first heating element positioned below one of the separately controlled cooking areas, a second heating element positioned below the same separately controlled cooking area as the first heating element, and a control switch coupled to the first heating element and the second heating element. The control switch is operable to energize only the first heating element when the switch is located at a first position, energize only the second heating element when the switch is located at a second position, and energize both the first heating element and second heating element when the switch is located at a third position.

In some embodiments, the cooking appliance may have a limit switch coupled to the second heating element. The limit switch is operable to de-energize the second heating element when the temperature of the separately controlled cooking area exceeds a specified temperature.

Additionally, in some embodiments, the control switch may be operable to energize only the first heating element with a first quantity of power when the switch is located at the first position such that only the first heating element supplies heat to the separately controlled cooking area. The control switch may be operable to increase the power supplied to the first heating element to a second quantity of power as the switch moves from the first position to the second position such that the first heating element supplies additional heat to the separately controlled cooking area.

In some embodiments, the control switch may be operable to energize only the second heating element with the second quantity of power when the switch is located at the second position such that only the second heating element supplies heat to the separately controlled cooking area. The control switch may be operable to increase the power supplied to the second heating element to a third quantity of power as the switch moves from the second position to the third position such that the second heating element supplies additional heat to the separately controlled cooking area.

In some embodiments, the control switch may be operable to supply power to energize the first heating element and the second heating element when the switch is located at the third position such that both the first heating element and the second heating element supply heat to the separately controlled cooking area. The sum of the power supplied to the first heating element and the second heating element is equal to the third quantity of power. Additionally, in some embodiments, the control switch may be operable to increase the power supplied to the first heating element and the second heating element as the switch moves from the third position to a fourth position such that additional heat is supplied to the separately controlled cooking area.

In some embodiments, the control switch may be operable to de-energize the first heating element and the second heating element when the switch is located at the fourth position. In some embodiments, the control switch may be an infinite switch. In some embodiments, the cooktop may be a glass-ceramic cooktop.

According to another aspect, a method of operating a cooking appliance includes energizing only a first heating element to supply heat to a separately controlled cooking area, energizing only a second heating element to supply heat to the separately controlled cooking area, and energizing both the first heating element and the second heating element to supply heat to the separately controlled cooking area. In some embodiments, energizing only the first heating element further includes supplying only the first heating element with a first quantity of power.

Additionally, in some embodiments, the method may include the step of increasing the power supplied to the first heating element to a second quantity of power to supply additional heat and raise the temperature of the separately controlled cooking area.

In some embodiments, energizing only the second heating element may include supplying only the second heating element with the second quantity of power. In some embodiments, the method may include the step of increasing the power supplied to the second heating element to a third quantity of power to increase the heat generated by the second heating element and raise the temperature of the separately controlled cooking area.

In some embodiments, energizing both the first heating element and the second heating element may include supplying power to the first heating element and the second heating element such that the sum of the power supplied to the first heating element and the second heating element is equal to the third quantity of power.

In some embodiments, the method may include the step of increasing the power supplied to the first heating element and the second heating element to increase the heat generated by the first heating element and the second heating element and raise the temperature of the separately controlled cooking area.

Additionally, in some embodiments, the method may include measuring the temperature of the separately controlled cooking area and de-energizing the second heating element when the temperature of the separately controlled cooking area exceeds a specified temperature. In some embodiments, the method may include de-energizing the first heating element and the second heating element.

According to another aspect, a cooking appliance has a cooktop including a plurality of separately controlled cooking areas. The cooking appliance also has a first heating element positioned below one of the plurality of separately controlled cooking areas, a second heating element positioned below the same separately controlled cooking area as the first heating element, and a control switch coupled to the first heating element and the second heating element. The control switch is operable to vary the power supplied to the first heating element and the second heating element. The control switch is operable to supply a first quantity of power to the first heating element when the switch is placed in a first position, supply a second quantity of power to the second heating element when the switch is placed in a second position, and supply power to the first heating element and the second heating element when the switch is placed in a third position, the sum of the power supplied to the first heating element and the second heating element being equal to a third quantity of power. In some embodiments, the control switch may be an infinite switch.

BRIEF DESCRIPTION OF THE DRAWINGS

The detailed description particularly refers to the following figures, in which.

DETAILED DESCRIPTION OF THE DRAWINGS

Figure 1:
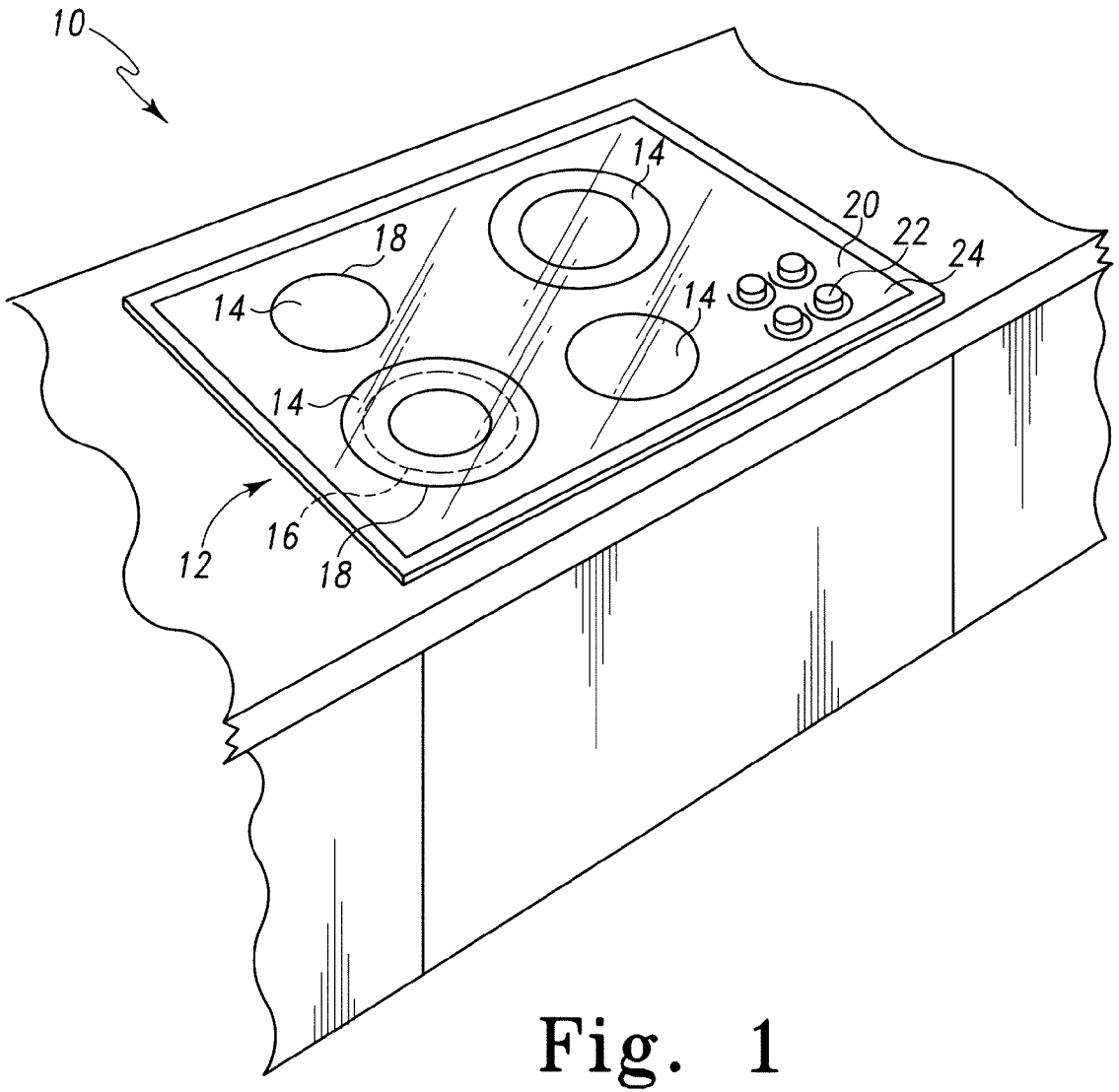
FIG. 1 is a perspective view of a cooking appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a cooking appliance 10 is shown. The cooking appliance 10 includes a cooktop 12. As shown in FIG. 1, the cooktop 12 is a glass-ceramic cooktop. The cooktop 12 has a plurality of separately controlled cooking areas 14. It should be appreciated that the term "separately controlled cooking area" as used herein refers to a location or zone of the cooktop that may be operated by the user independently from the remainder of the cooktop. A separately controlled cooking area may have a burner or other heating device dedicated to supplying heat to it. The heat supplied to each separately controlled heating area is controlled such that a command to change the heat supplied to it does not change the amount of heat supplied to any other separately controlled cooking area. In the illustrative embodiment of FIG. 1, the cooktop 12 has four separately controlled cooking areas 14.

A heating device 16 is positioned below each separately controlled cooking area 14. Each heating device 16 is operable to heat only the corresponding separately controlled cooking area 14 to desired cooking temperatures. An outer perimeter 18 designates to the user where the user should place pots, pans, and the like to be heated by each separately controlled cooking area 14.

The cooking appliance 10 also includes a control panel 20 positioned adjacent to the cooktop 12. A user may separately control the temperature of each of the plurality of separately controlled cooking areas 14 using a set of knobs 22 positioned on a top surface 24 of the control panel 20. As the user rotates one of the knobs 22, a control switch 30 (see FIG. 2) coupled to the knob 22 adjusts the heat generated by the corresponding heating device 16 to change the temperature of one of the plurality of separately controlled cooking areas 14.

Figure 2:
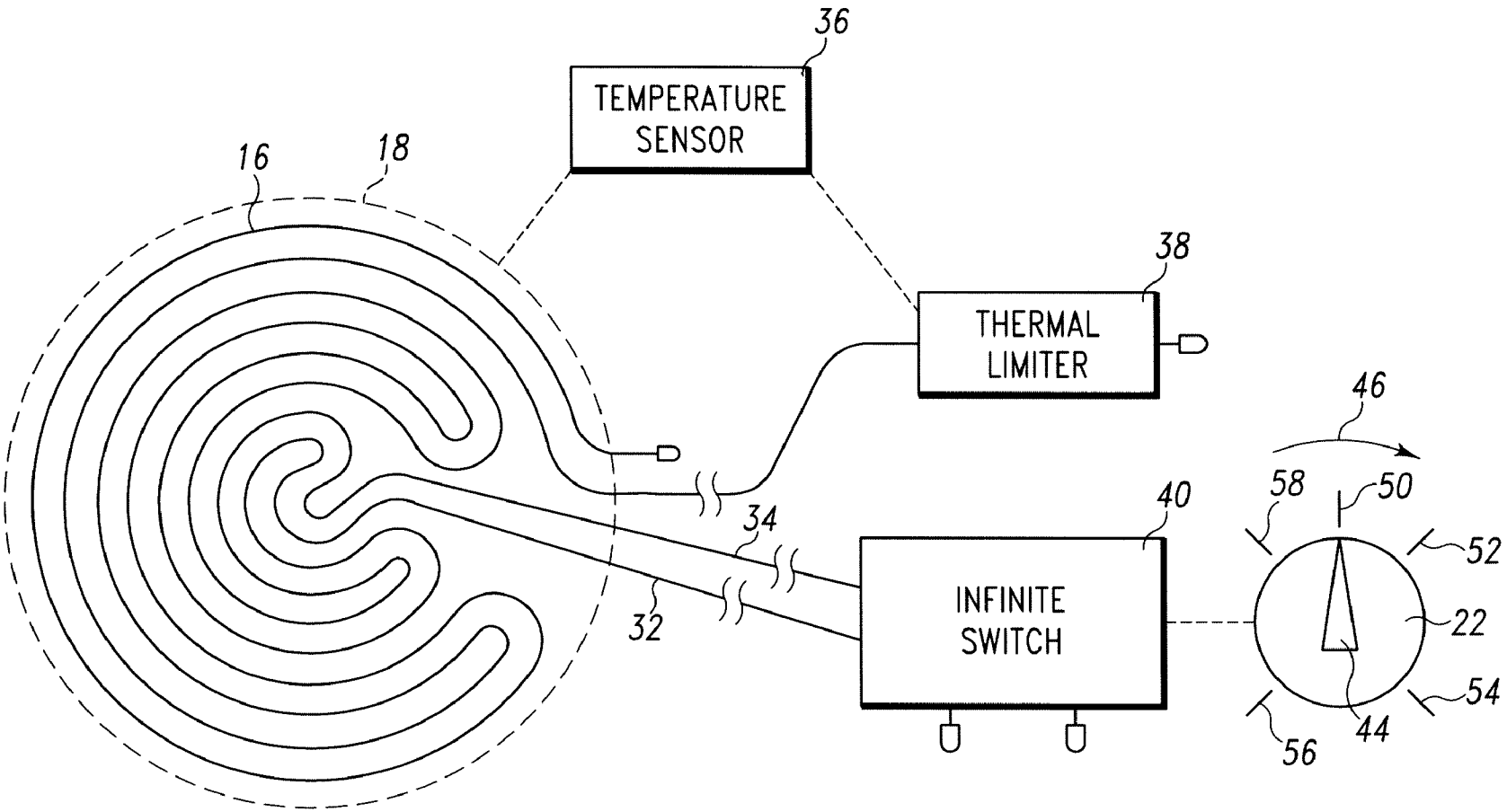
FIG. 2 is a top plan view of a heating device of the cooking appliance of FIG. 1.

Referring to FIG. 2, a heating device 16 is shown in greater detail. The heating device 16 is positioned below one of the separately controlled cooking areas 14. The heating device 16 includes a resistive heating element 32 and a resistive heating element 34 that fit within the outer perimeter 18. The heating elements 32, 34 each generate heat when energized with electrical power generated by an electrical power supply (not shown). In the embodiment of FIG. 2, the heating element 32 is a low wattage-heating element and the heating element 34 is a high wattage-heating element. As a high wattage-heating element, the heating element 34 can generate more heat when fully energized with power than the low wattage-heating element 32.

The heating elements 32, 34 supply heat to the separately controlled cooking area 14, which raises the temperature of that cooking area 14. A temperature sensor 36 is operable to measure the temperature of the separately controlled cooking area 14. The measured temperature is relayed to a thermal limiter 38 coupled to the heating element 34. The temperature sensor 36 and the thermal limiter 38 are components of the cooking appliance's control circuit. When the measured temperature exceeds a predetermined threshold, the thermal limiter 38 is operable to deenergize the heating element 34 by severing its connection to the power supply. In this way, the thermal limiter 38 prevents the heating device 16 from subjecting the separately controlled cooking area 14 to temperatures that would damage the cooktop 12. When the temperature measured by the temperature sensor 36 drops below the predetermined threshold, the thermal limiter 38 reconnects the heating element 34 to the power supply, allowing the heating element 34 to generate heat, which is supplied to the separately controlled cooking area 14.

The heating elements 32, 34 are coupled to the control switch 30, which is another component of the cooking appliance's control circuit. The control switch 40 is operable to selectively energize the heating elements 32, 34 and vary the amount of power supplied to each element. Varying the power supplied to each of the heating elements 32, 34 changes the quantity of heat generated by each of the heating elements 32, 34 and, consequently, changes the temperature of the separately controlled cooking area 14. As shown in FIG. 2, the control switch 40 is embodied as an infinite switch. It will be appreciated that in other embodiments the control switch 40 may be a touch screen, electronic button, or other like device operable to vary the power supplied to the heating elements 32, 34.

The control switch 40 is coupled to the knob 22 via a rotating shaft (not shown). The knob 22 includes a pointer 44 that indicates the angular position of both the knob 22 and the control switch 40. Depending on the angular position of the control switch 40, power may be supplied to only the heating element 32, only the heating element 34, or both heating elements 32, 34 together. As shown in FIG. 2, the knob 22 and control switch 40 are shown in a starting position 50. When the control switch 40 is located at the position 50, no power is supplied to either heating element and both the heating element 32 and the heating element 34 are de-energized. As the knob 22 is rotated in the direction indicated by an arrow 46, the control switch 40 selectively supplies power to the heating elements 32, 34.

In addition to the starting position 50, several other angular positions of the knob 22 and the control switch 40 are shown in FIG. 2, including a first position 52, a second position 54, a third position 56, and a fourth position 58. When the knob 22 is located at the first position 52, or in the zone between the first position 52 and the second position 54, the control switch 40 permits power to be supplied to only the heating element 32. Because the heating element 34 does not receive power, the heating element 34 is de-energized.

When the knob 22 is located at the second position 54, or in the zone between the second position 54 and the third position 56, the control switch 40 permits power to be supplied to only the heating element 34. Because the heating element 32 does not receive power, the heating element 32 is de-energized. When the knob 22 is located at the third position 56, or in the zone between the third position 56 and the fourth position 58, the control switch 40 permits power to be supplied to both the heating element 32 and the heating element 34 such that both heating elements 32, 34 are energized.

When the knob 22 is located at the fourth position 58, the control switch 40 prevents power from being supplied to the either of the heating elements 32, 34 and both heating elements 32, 34 are de-energized. The heating elements 32, 34 are also de-energized when the knob 22 is located in the zone including the starting position 50 between the fourth position 58 and the first position 52.

Figure 3:
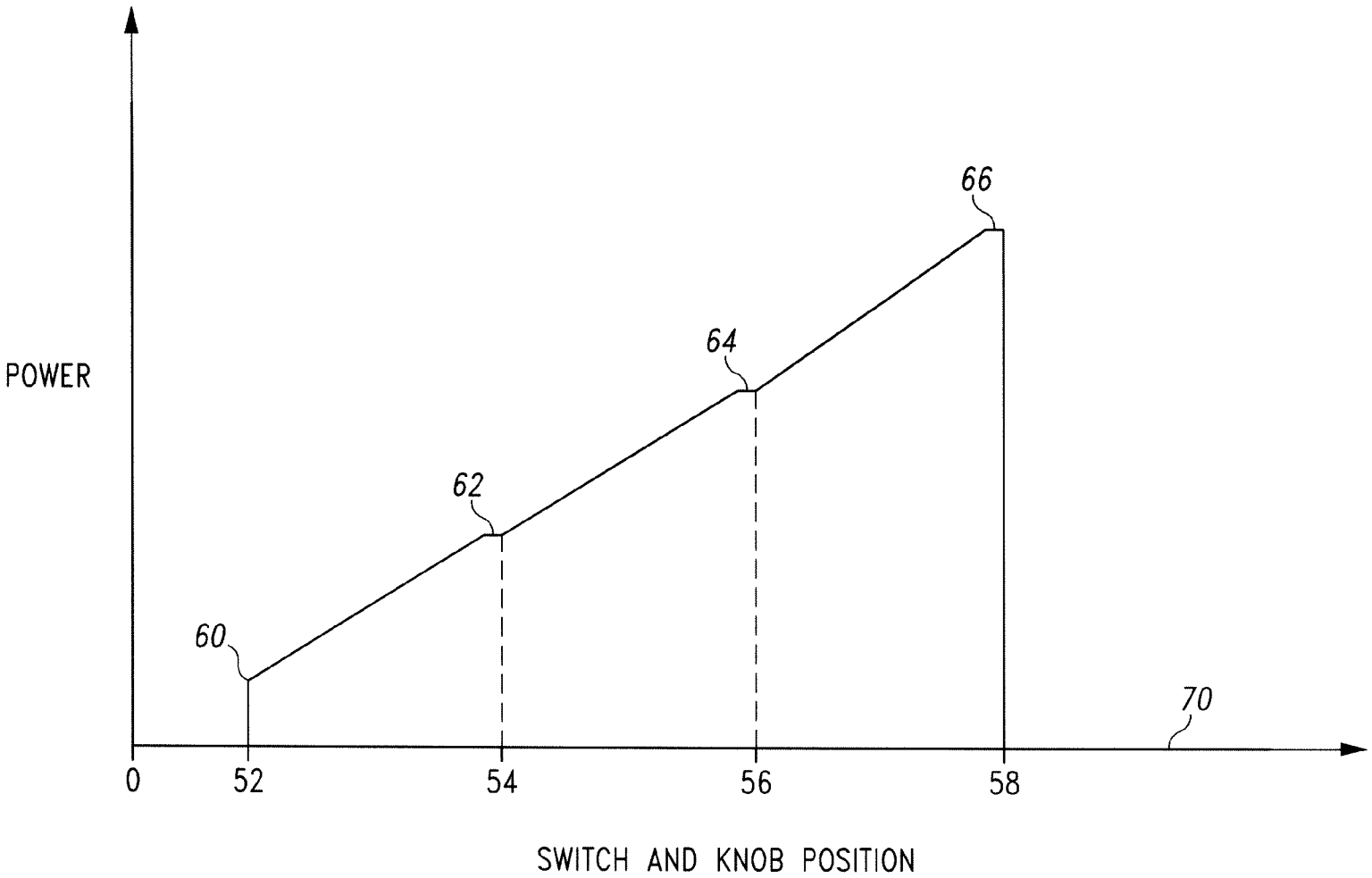
FIG. 3 is a graph of the average power supplied to the heating device of FIG. 2 as a function of the position of a control switch.

In addition to selectively energizing the heating elements 32, 34, the control switch 40 varies the amount of power supplied to each of the heating elements 32, 34. The average power supplied to the heating elements 32, 34 is shown in FIG. 3 as a function of the position of the knob 22 and the control switch 40. The starting position 50, the first position 52, the second position 54, the third position 56, and the fourth position 58 are demarcated along a first axis 70. As shown in FIG. 3, the average power supplied to the heating elements 32, 34 increases as control switch 40 transitions from the starting position 50 to the fourth position 58. Because the heating elements 32, 34 generate heat in proportion to the amount of power supplied, the heat generated by the heating elements 32, 34 also increases as the control switch 40 moves from starting position 50 through the fourth position 58.

When the knob 22 is located at the position 52, the control switch 40 energizes the heating element 32 with a first quantity of power 60, and the heating element 32 immediately begins supplying heat to the separately controlled cooking area 14. In the embodiment of FIGS. 1-3, the first quantity of power 60 supplied to heating element 32 is equal to approximately six percent of the maximum wattage of heating element 32. It should be appreciated that in other embodiments the heating element 32 may be supplied with a greater or lesser quantity of power when energized at position 52.

As the knob 22 is rotated from the position 52 to the position 54, the control switch 40 increases the power supplied to the heating element 32 such that the heating element 32 supplies additional heat to the separately controlled cooking area 14. That influx of additional heat raises the temperature of that cooking area 14. The power supplied to the heating element 32 gradually increases to a second quantity of power 62 before the control switch 40 reaches the position 54. In the embodiment of FIGS. 1-3, the second quantity of power 62 is equal to the maximum wattage of heating element 32.

When the knob 22 is located at the position 54, the control switch 40 de-energizes the heating element 32 and energizes only the heating element 34 with the second quantity of power 62. In other words, when the heating element 34 is first energized at the position 54, it is supplied with power at the same level supplied to the heating element 32 before the heating element 32 was de-energized. It should be appreciated that in other embodiments the heating element 34 may be supplied with a greater or lesser quantity of power when energized at position 54. Once energized, the heating element 34 immediately begins supplying heat to the separately controlled cooking area 14.

As the knob 22 is rotated from the position 54 to the position 56, the control switch 40 increases the power supplied to the heating element 34 such that the heating element 34 supplies additional heat to the separately controlled cooking area 14. That influx of additional heat raises the temperature of that cooking area 14. The power supplied to the heating element 34 gradually increases to a third quantity of power 64 before the knob 22 reaches the position 56. In the embodiment of FIGS. 1-3, the third quantity of power 64 is equal to the maximum wattage of heating element 34.

When the knob 22 is located at the position 56, the control switch 40 energizes both heating elements 32, 34 with power and both heating elements 32, 34 supply heat to the separately controlled cooking area 14. The sum of the power supplied to both heating elements 32, 34 is equal to the third quantity of power 64. In other words, the third quantity of power 64 is divided between the heating elements 32, 34 and both heating elements 32, 34 are operated at less than their respective maximum wattages at the position 56.

As the knob 22 is rotated from the position 56 to the position 58, the control switch 40 increases the power supplied to both heating elements 32, 34 such that additional heat is supplied to the separately controlled cooking area 14. That influx of additional heat raises the temperature of that cooking area 14. The total power supplied to the heating elements 32, 34 increases to a fourth quantity of power 66 before the knob 22 reaches the position 58. In the embodiment of FIGS. 1-3, the fourth quantity of power 66 is equal to the sum of the maximum wattage of heating element 32 and the maximum wattage of heating element 34.

When the knob 22 is located at position 58, the control switch 40 supplies no power to either of the heating elements 32, 34 and both heat elements 32, 34 are de-energized.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A cooking appliance, comprising:

a cooktop including a plurality of separately controlled cooking areas, a first heating element positioned below one of the separately controlled cooking areas, a second heating element positioned below the same separately controlled cooking area as the first heating element, the second heating element and the first heating element being non-concentric, and a control switch coupled to the first heating element and the second heating element, wherein the control switch is operable to (i) energize only the first heating element with a first quantity of power when the switch is located at a first position such that only the first heating element supplies heat to the separately controlled cooking area, (ii) energize only the second heating element when the switch is located at a second position, (iii) energize both the first heating element and the second heating element when the switch is located at a third position, and (iv) increase the power supplied to the first heating element to a second quantity of power as the switch is moved from the first position to the second position such that the first heating element supplies additional heat to the separately controlled cooking area.

2. The cooking appliance of claim 1, further comprising:

a limit switch coupled to the second heating element, the limit switch being operable to de-energize the second heating element when the temperature of the separately controlled cooking area exceeds a specified temperature.

3. The cooking appliance of claim 1, wherein:

the control switch is operable to energize only the second heating element with the second quantity of power when the switch is located at the second position such that only the second heating element supplies heat to the separately controlled cooking area, and the control switch is operable to increase the power supplied to the second heating element to a third quantity of power as the switch moves from the second position to the third position such that the second heating element supplies additional heat to the separately controlled cooking area.

4. The cooking appliance of claim 3, wherein:

the control switch is operable to supply power to energize the first heating element and the second heating element when the switch is located at the third position such that both the first heating element and the second heating element supply heat to the separately controlled cooking area, and the sum of the power supplied to the first heating element and the second heating element is equal to the third quantity of power.

5. The cooking appliance of claim 4, wherein the control switch is operable to increase the power supplied to the first heating element and the second heating element as the switch moves from the third position to a fourth position such that additional heat is supplied to the separately controlled cooking area.

6. The cooking appliance of claim 5, wherein the control switch is operable to de-energize the first heating element and the second heating element when the switch is located at the fourth position.

7. The cooking appliance of claim 1, wherein the control switch is an infinite switch.

8. The cooking appliance of claim 1, wherein the cooktop is a glass-ceramic cooktop.

9. A cooking appliance, comprising:

a cooktop including a plurality of separately controlled cooking areas, a first heating element positioned below one of the plurality of separately controlled cooking areas, the first heating element being operable to supply heat to the separately controlled cooking area when energized, a second heating element positioned below the same separately controlled cooking area as the first heating element, the second heating element being operable to supply heat to the separately controlled cooking area when energized, the second heating element and the first heating element being non-concentric, and a control switch coupled to the first heating element and the second heating element, the control switch being operable to vary the power supplied to the first heating element and the second heating element, wherein the control switch is operable to: (i) supply a first quantity of power to the first heating element when the switch is placed in a first position, (ii) supply a second quantity of power to the second heating element when the switch is placed in a second position, and (iii) supply power to the first heating element and the second heating element when the switch is placed in a third position, the sum of the power supplied to the first heating element and the second heating element being equal to a third quantity of power.

10. The cooking appliance of claim 9, wherein the control switch is an infinite switch.

* * * * *